US005640011A

United States Patent [19]

Wells

[11] Patent Number: 5,640,011

[45] Date of Patent: Jun. 17, 1997

[54] METHOD OF DETECTING SELECTED ION SPECIES IN A QUADRUPOLE ION TRAP

[75] Inventor: Gregory J. Wells, Fairfield, Calif.

[73] Assignee: Varian Associates, Inc., Palo Alto, Calif.

[21] Appl. No.: 726,758

[22] Filed: Oct. 9, 1996

Related U.S. Application Data

[63] Continuation of Ser. No. 469,405, Jun. 6, 1995, abandoned.

[51] Int. Cl.[6] ..... H01J 49/42

[52] U.S. Cl. ..... 250/282; 250/292

[58] Field of Search ..... 250/282, 292

[56] References Cited

U.S. PATENT DOCUMENTS

| | | | |
|---|---|---|---|
| 2,939,952 | 6/1960 | Paul et al. | 250/41.9 |
| 4,540,884 | 9/1985 | Stafford et al. | 250/282 |
| 4,736,101 | 4/1988 | Syka et al. | 250/292 |
| 4,749,860 | 6/1988 | Kelley et al. | 250/282 |
| 4,761,545 | 8/1988 | Marshall et al. | 250/291 |
| 5,134,286 | 7/1992 | Kelley | 250/282 |
| 5,198,665 | 3/1993 | Wells | 250/282 |
| 5,256,875 | 10/1993 | Hoekman et al. | 250/282 |
| 5,291,017 | 3/1994 | Wang et al. | 250/292 |
| 5,521,380 | 5/1996 | Wells et al. | 250/282 |

FOREIGN PATENT DOCUMENTS

| | | |
|---|---|---|
| 0 270 232 A1 | 6/1988 | European Pat. Off. . |
| 0 362 432 A1 | 4/1990 | European Pat. Off. . |
| 0 383 961 A1 | 8/1990 | European Pat. Off. . |
| 0 581 600 A2 | 2/1994 | European Pat. Off. . |
| 1270815 | 11/1986 | U.S.S.R. . |

OTHER PUBLICATIONS

Dawson et al., "A Simple Mass Spectrometer", The Review of Scientific Instruments, vol. 40, No. 11, pp. 1444–1450. Nov. 1969.

Dawson et al., "Ion Storage . . . ", The Journal of Vacuum Science and Technology, vol. 5, No. 1, pp. 1–10. 1968.

Michael et al., "An ion trap storage/time–of–flight mass spectrometer", Review of Scientific Instruments, 63 (10), pp. 4277–4284. Oct. 1992.

*Primary Examiner*—Jack I. Berman

*Attorney, Agent, or Firm*—David Schmapf; Edward Berkowitz

[57] ABSTRACT

A method of detecting ions of a single ion species that have been selectively stored in a quadrupole ion trap mass spectrometer is disclosed. After the selected ion species is isolated the trapping field in rapidly changed to cause ions to leave the ion trap in the axial direction where they are detected using a conventional detector. Preferably, a dipole pulse is applied to the ion trap simultaneously with the reduction of the trapping field, such that all of the ions are caused to leave the trap in a single direction, doubling the ion current over prior art methods. The method of the invention allows ejection of all of the ions in a time period which is nearly twenty times faster than the prior art resonance ejection scanning technique, and without the artifacts in the signal current caused by frequency beating.

8 Claims, 7 Drawing Sheets

METHOD OF DETECTING SELECTED ION SPECIES IN A QUADRUPOLE ION TRAP

This application is a continuation of application Ser. No. 08/469,405, filed Jun. 6, 1995, now abandoned.

FIELD OF THE INVENTION

The present invention is related to methods of using quadrupole ion trap mass spectrometers, and is particularly related to methods of detecting selected ion species which have been isolated within such devices.

BACKGROUND OF THE INVENTION

The present invention relates to methods of using the three-dimensional quadrupole ion trap mass spectrometer ("ion trap") which was initially described by Paul, et al.; see, U.S. Pat. No. 2,939,952. In recent years, use of the ion trap mass spectrometer has grown dramatically, in part due to its relatively low cost, ease of manufacture, and its unique ability to store ions over a large range of masses for relatively long periods of time. This latter feature makes the ion trap especially useful in isolating and manipulating individual ion species, as in a so-called tandem MS or "MS/MS" or $MS^n$ experiment where a "parent" ion species is isolated and fragmented or dissociated to create "daughter" ions, which may then be identified using traditional ion trap detection methods or further fragmented to create granddaughter ions, etc.

Isolation of individual ion species also has importance in other applications beside isolation of parent ions for MS/MS experiments. Given the relatively low cost and sensitivity of present-day commercial ion traps, they can be used to monitor for the presence of specific compounds or groups of related compounds, e.g., monitoring for the release of toxic gases in an production area. Controlling an ion trap to selectively isolate specific ion species of interest can be used to optimize the sensitivity of the trap for the selected species, which otherwise would be poorly detectable or completely undetectable.

As is well known, the quadrupole ion trap comprises a ring-shaped electrode and two end cap electrodes. Ideally, both the ring electrode and the end cap electrodes have hyperbolic surfaces that are coaxially aligned and symmetrically spaced. By placing a combination of AC and DC voltages (conventionally designated "V" and "U", respectively) on these electrodes, a quadrupole trapping field is created. A trapping field may be simply created by applying a fixed frequency (conventionally designated "f") AC voltage between the ring electrode and the end caps to create a quadrupole trapping field. The use of an additional DC voltage is optional, and in commercial embodiments of the ion trap a DC trapping voltage is not normally used. It is well known that by using an AC voltage of proper frequency and amplitude, a wide range of masses can be simultaneously trapped.

The mathematics of the quadrupole trapping field created by the ion trap were described in the original Paul, et al., patent. For a trap having a ring electrode of a given equatorial radius $r_0$, with end cap electrodes displaced from the origin at the center of the trap along the axial line r=0 by a distance $z_0$, and for given values of U, V and f, whether an ion of mass-to-charge ratio (m/e, also frequently designated m/z) will be trapped depends on the solution to the following two equations:

$$a_z = \frac{-16eU}{m(r_0^2 \cdot 2z_0^2)\omega^2} \quad \text{Eq. 1}$$

$$q_z = \frac{+8eV}{m(r_0^2 \cdot 2z_0^2)\omega^2} \quad \text{Eq. 2}$$

where ω is equal to 2πf.

Solving these equations yields values of $a_z$ and $q_z$ for a given ion species having the selected m/e. If the point ($a_z$, $q_z$) maps inside the "stability envelop" for the ion trap, the ion will be trapped by the quadrupole field. If the point ($a_z$, $q_z$) falls outside the stability envelop, the ion will not be trapped and any such ions that are introduced within the ion trap will quickly move out of the trap. By changing the values of U, V or f one can affect the stability of a particular ion species. Note that from Eq. 1, when U=0, (i.e., when no DC voltage is applied to the trap), $a_z$=0.

(It is common in the field to speak of the "mass" of an ion as shorthand for its mass-to-charge ratio. As a practical matter, most of the ions in an ion trap are singly ionized, such that the mass-to-charge ratio is the same as the mass. For convenience, this specification adopts the common practice, and generally uses the term "mass" as shorthand to mean mass-to-charge ratio.)

Each ion in the trapping field has a "secular" frequency which depends on the mass of the ion and on the trapping field parameters. As is well-known, it is possible to excite ions of a given mass that are stably held by the trapping field by applying a supplemental AC dipole voltage to the ion trap having a frequency equal to the secular frequency of the ion mass. Ions in the trap can be made to resonantly absorb energy in this manner. When the supplemental dipole voltage is relatively low, it can be used to cause ions of a specific mass to resonate within the trap, undergoing dissociating collisions within molecules of a background gas in the process. This technique, called collision induced dissociation or "CID," is commonly used in MS/MS to dissociate parent ions to create daughter ions. At higher voltages, sufficient energy is imparted by the supplemental voltage to cause those ions having a secular frequency matching the frequency of the supplemental voltage to leave the trap volume. This technique is now commonly used to eliminate unwanted ions from the ion trap, and to scan the trap to eject ions from the trap for detection by an external detector.

The typical basic method of using a commercial ion trap consists of applying an rf trapping voltage ($V_0$) to the trap electrodes to establish a trapping field which will retain ions over a wide mass range, introducing a sample into the ion trap, ionizing the sample, and then scanning the contents of the trap so that the ions stored in the trap are ejected and detected in order of increasing mass. Typically, ions are ejected through perforations in one of the end cap electrodes and are detected with an electron multiplier. More elaborate experiments, such as MS/MS, generally build upon this basic technique, and often require the isolation of a specific ion mass in the ion trap.

Once the ions are formed and stored in the trap a number of techniques are available for isolating specific ions of interest. It is well-known that when the trapping field includes a DC component, the trapping field parameters (i.e., U, V and f) can be adjusted to isolate a single ion species, or a very narrow mass range, in the trap. A problem with this approach is that it is difficult to control the trapping field parameters with the high degree of precision, and it is difficult to calculate the precise combination of trapping field parameters needed to isolate a single mass or a narrow range of masses. Another problem is that most commercial ion traps do not have the ability to apply a DC trapping voltage, and adding this capability increases the amount and cost of the system hardware that is required. Finally, it is noted that when using this technique, the ions that are to be retained in the field will be near the edge of the stability boundary, so that the trapping efficiency is not optimal, and may be rather poor.

U.S. Pat. No. 4,736,101 describes another method of isolating an ion for MS/MS experiments. According to the technique taught by the '101 patent, a trapping field is established to trap ions having masses over a wide range. This is done in a conventional manner, as was well known in the art. Next, the trapping field is changed to eliminate ions other than the selected ion of interest. To do this the rf trapping voltage applied to the ion trap is ramped so as to cause ions of low mass to sequentially become unstable and be eliminated from the trap. The ramping of the rf trapping voltage is stopped at the point at which the mass just below the ion of interest is eliminated from the ion trap. The '101 patent does not teach how to manipulate the trapping field to eliminate ions having a mass that is higher than the mass of interest when no DC trapping voltage is applied. After the contents of the ion trap have been limited by the foregoing technique of changing the trapping voltage, the trapping voltage is relaxed so that, once again, ions over a broad range are trapped. Next, the parent ions within the ion trap are dissociated, preferably using CID, to form daughter ions. Finally, the ion trap is scanned by again ramping the quadrupole trapping voltage so that ions over the entire mass range sequentially become unstable and leave the trap.

The major deficiency of the method of the '101 patent is its failure to teach how to eliminate high mass ions from the trap without using a trapping field having a DC component. In addition, the technique of causing the low mass ions to be eliminated from the ion trap by instability scanning is also problematic. If $m_P$ is the mass to be retained in the trap, and the trapping field is manipulated to cause $m_{P-1}$ to become unstable, then $m_P$ will, at that point, be very close to the stability boundary. Again, this may cause the trapping efficiency for $m_P$ to be quite low, and requires precise control of the trapping voltage as it is ramped to eliminate unwanted low mass ions.

Another method of isolating an individual ion species in an ion trap is described in U.S. Pat. No. 5,198,665 (the '665 patent) issued to the present inventor and coassigned herewith. (The disclosure of the '665 patent is hereby incorporated by reference.) According to the '665 patent, masses lower than the mass to be retained ($m_P$) are first sequentially scanned out of the trap using resonance ejection. This has the advantage that $m_{P-1}$ can be eliminated from the trap while $m_P$ is far from the stability boundary. After the low mass ions are so eliminated, a broadband supplemental signal is applied to the trap to eliminate the higher mass ions. The trapping voltage may be reduced slightly while applying the supplemental broadband voltage to bring ions just above $m_P$ into resonance. This technique is capable of producing highly accurate results. Since high mass ions remain in the trap while the low mass ions are being eliminated, a significant space charge remains. Unless proper measures are taken, this space charge can interfere with the accuracy of experiments using the technique.

It is also known in the prior art to apply various types of supplemental broadband voltage signals to the ion trap to simultaneously eliminate multiple unwanted ion species from the trap. The prior art generally teaches use of (1) broadband signals that are constructed from discrete frequency components corresponding to the resonant frequencies of the unwanted ions; and (2) broadband noise signals that essentially contain all frequencies, such that they act on the entire mass spectrum, and which are filtered to remove frequency components corresponding to the secular frequency(ies) of the ions that are to be retained in the ion trap. In all of the known prior art methods, the trapping field is held constant while the supplemental broadband voltage is applied to the ion trap. Examples of such techniques are shown in U.S. Pat. Nos. 5,134,286; 5,256,875; and 4,761,545.

None of the patents which teach the use of broadband excitation signals to eliminate unwanted ions from the ion trap en masse, adequately address the fact that the spacing of the secular frequencies of adjacent ion masses varies across the mass spectrum. For low masses, the secular frequencies of adjacent integer masses are far apart, whereas at high masses they are quite close. As a result, at low masses, if the ion of interest is not an integer mass, or if space charge or trapping field irregularities have caused a shift in the nominal secular frequency, there is a risk that the mass will not be excited and eliminated. On the other hand, in the high mass range, a single frequency component may cause resonance of multiple mass values, in which case a narrow "notch" in the broadband signal might not be sufficient to ensure that a desired ion will be retained in the ion trap.

A disadvantage of the prior art, which relies on waveforms containing a very large number of frequency components, is the high power requirements associated with having each of the frequency components present at sufficiently high power levels to cause excitation of ions across the mass spectrum. This disadvantage exists both for noise signals and for constructed waveforms, i.e., waveforms in which the frequency components are predetermined either by direct frequency selection or by an algorithm, such as an inverse Fourier transform of a frequency domain excitation spectrum to create a time domain excitation waveform. In a constructed waveform, it is important to further control the phases of the frequency components to minimize the dynamic range of the excitation waveform. As the number of frequency components increases, more elegant and time-consuming techniques are needed to create a time domain signal with a reasonable dynamic range, i.e., a minimized peak-to-peak voltage. For example, the '875 patent teaches a rather complex and time-consuming iterative technique for generating a supplemental voltage waveform.

Whatever technique is used to isolate a selected ion species in an ion trap, each of the methods uses essentially the same method for subsequently detecting the isolated species, i.e., scanning the contents of the trap. In the prior art method of scanning the contents of the trap, a supplemental AC voltage is applied across the end caps of the ion trap to create an oscillating dipole field supplemental to the quadrupole trapping field. (Sometimes the combination of the quadrupole trapping field and the supplemental rf dipole field is referred to as a "combined field.") In this scanning method, the supplemental AC voltage has a different frequency than the primary AC trapping voltage. The supplemental AC voltage causes trapped ions of specific mass to resonate at their secular frequency in the axial direction. When the secular frequency of an ion equals the frequency of the supplemental voltage, energy is efficiently absorbed by the ion. When enough energy is coupled into the ions of a specific mass in this manner, they are ejected from the trap in the axial direction where they are detected by a detector. The technique of using a supplemental dipole field to excite specific ion masses is sometimes called axial modulation.

In this prior art scanning method there are two ways of bringing ions of masses present in the trap into resonance with the supplemental AC voltage: scanning the frequency of the supplemental voltage in a fixed trapping field, or varying the magnitude V of the AC trapping voltage while holding the frequency of the supplemental voltage constant. Typically, when using axial modulation to scan the contents of an ion trap, the frequency of the supplemental AC voltage is held constant and V is ramped so that ions of successively higher mass are brought into resonance and ejected. The advantage of ramping the value of V is that it is relatively simple to perform and provides better linearity than can be attained by changing the frequency of the supplemental voltage. The method of scanning the trap by using a supplemental voltage will be referred to as resonance ejection scanning.

In commercial embodiments of the ion trap using resonance ejection as a scanning technique, the frequency of the supplemental AC voltage is set at approximately one half of the frequency of the AC trapping voltage. It can be shown that the relationship of the frequency of the trapping voltage and the supplemental voltage determines the value of $q_z$ (as defined in Eq. 2 above) of ions that are at resonance.

A technique commonly referred to as "mass instability scanning," described in U.S. Pat. No. 4,540,884, is also known in the prior art to scan the contents of the ion trap for detection and analysis. The '884 patent teaches scanning one or more of the basic trapping parameters of the quadrupole trapping field, i.e., U, V or f, to sequentially cause trapped ions to become unstable and leave the trap. The '884 patent teaches scanning a trapping parameter such that the unstable ions tend to leave in the axial direction where they can be detected using a number of techniques, for example, as mentioned above, a electron multiplier or Faraday collector connected to standard electronic amplifier circuitry. Nonetheless, resonance ejection scanning of trapped ions provides better sensitivity than can be attained using the mass instability technique taught by the '884 patent, and produces narrower, better defined peaks, i.e., resonance ejection scanning produces better overall mass resolution. Resonance ejection scanning also substantially increases the ability to analyze ions over a greater mass range.

Whichever method is used to scan the trap, ions are equally likely to move in either direction along the trap axis. Thus, half of the ions will move in the axial direction away from the detector and the other half will move toward the detector. This significantly limits the detection efficiency of the device. An additional disadvantage of the prior art resonance scanning technique can be seen by reference to FIG. 1. This figure shows the signal directly at the output of detector (i.e., before any filtering or other processing), resulting from a single scan of an isolated mass (perfluorotributylamine, "PFTBA," m/z=131). The divisions depicted on the horizontal axis are in increments of 50 μsec, and the time required to scan the single isolated mass is approximately 180 μsec. The high frequency oscillations that are apparent in the ion signal are the result of a frequency beating between the rf trapping voltage at 1050 kHz and the dipole supplemental ejection voltage at 485 kHz. The resulting beat frequency is 80 kHz. In the prior art, order to overcome the poor quality of the peak from a single scan, it has been necessary to average several scans in order to obtain a smooth peak with an accurately centered mass value. Such an averaged value, taken from many scans, is shown in FIG. 2. FIG. 3 shows the peak of FIG. 2 after it has been further processed by an integrator.

The flow from a GC is continuous, and a modem high resolution GC produces narrow peaks, sometimes lasting only a matter of seconds. In order to obtain a mass spectra of narrow peaks, it is necessary to perform at least one complete scan of the ion trap per second. The need to perform rapid scanning of the trap adds constraints which may also affect mass resolution and reproducibility. Similar constraints exist when using the ion trap with an LC or other continuously flowing, variable sample stream. Averaging scans in order to obtain accurate mass peaks reduces the scan cycle time and hence the number of different masses that can be monitored per unit time across a chromatographic peak. It is noted that the time for a single scan is more than just the scan time itself, since it must also include the ionization and ion isolation time, both of which are generally longer than the scan itself. Therefore, scan averaging for purposes of peak smoothing is an inherently inefficient process.

SUMMARY OF THE INVENTION

Accordingly, it is an object of the present invention to provide a method of using an ion trap mass spectrometer to detect selected ions masses which have been isolated within the trap volume.

Another object of the present invention is to reduce the time needed to obtain a smooth, accurately centered mass peak of an ion species which has been isolated in an ion trap.

Still another object of the present invention is to avoid the need to perform multiple scans of an ion trap in order to obtain an accurate, centered mass peak of an ion species which has been isolated in the ion trap.

Yet another object of the present invention is to increase the proportion of ions ejected from an ion trap which are subject to capture by an external detector such that substantially more than one half of the ions are detected.

These and other objects which will be apparent to those skilled in the art upon reading the present specification in conjunction with the attached drawings and the appended claims, are realized in the present invention comprising a method of detecting ions which have been isolated in an ion trap mass spectrometer. In its broad aspect, the present invention comprises a method of using a quadrupole ion trap mass spectrometer, comprising the steps of isolating a selected ion species within the ion trap, rapidly changing the trapping field parameters such that the isolated ion species is no longer stably trapped within the trapping field, and detecting the unstable ions using an external detector. Preferably, the inventive method also includes the step of applying a dipole pulse across the end cap electrodes of the ion trap at substantially the same time the trapping field is rapidly changed, and the step of rapidly changing the trapping field comprises substantially eliminating the trapping field voltage.

DETAILED DESCRIPTION

Figure 4:
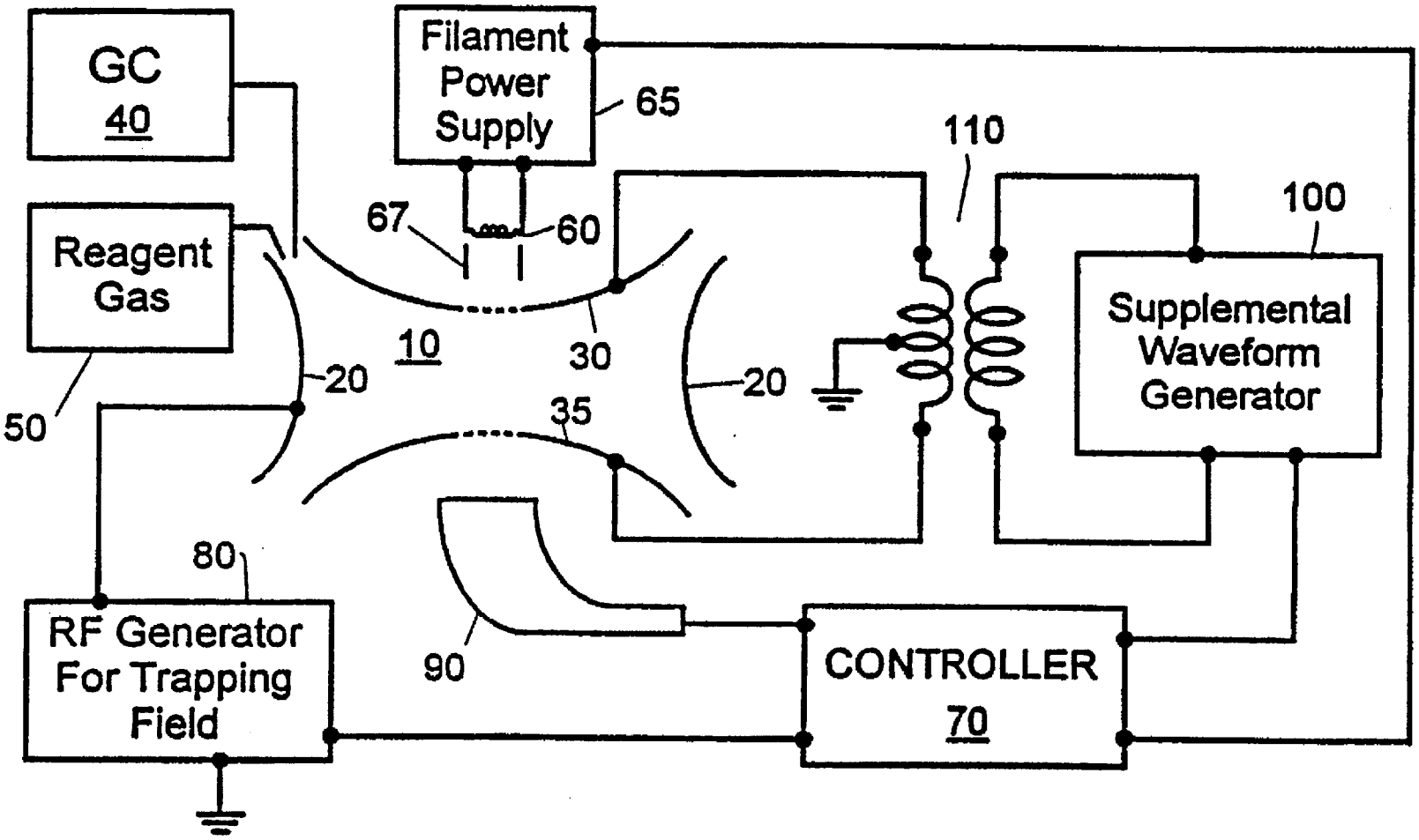
FIG. 4 is a partially schematic illustration of an ion trap mass spectrometer system of the type used to practice the methods of the present invention.

Apparatus of the type which may be used in performing the method of the present invention is shown in FIG. 4, and is well known in the art. Ion trap 10, shown schematically in cross-section, comprises a ring electrode 20 coaxially aligned with upper and lower end cap electrodes 30 and 35, respectively. These electrodes define an interior trapping volume. Preferably, the trap electrodes have hyperbolic inner surfaces, although other shapes, for example, electrodes having a cross-section forming an arc of a circle, may also be used to create trapping fields that are adequate for many purposes. The design and construction of ion trap mass spectrometers is well-known to those skilled in the art and need not be described in detail. A commercial model ion trap of the type described herein is sold by the assignee hereof A commercial model ion trap of the type described herein is sold by the assignee hereof under the model designation "Saturn."

Sample, for example from gas chromatograph ("GC") 40, is introduced into the ion trap 10. Since GCs typically operate at atmospheric pressure while ion traps operate at greatly reduced pressures, pressure reducing means (e.g., a vacuum pump and appropriate valves, etc., not shown) are required. Such pressure reducing means are conventional and well known to those skilled in the art. While the present invention is described using a GC as a sample source, the source of the sample is not considered a part of the invention and there is no intent to limit the invention to use with gas chromatographs. Other sample sources, such as, for example, liquid chromatographs with specialized interfaces, may also be used. For some applications, no sample separation is required, and sample gas may be introduced directly into the ion trap.

A source of reagent gas 50 may also be connected to the ion trap for conducting chemical ionization experiments. Sample and reagent gas that is introduced into the interior of ion trap 10 may be ionized by using a beam of electrons, such as from a thermionic filament 60 powered by filament power supply 65, and controlled by a gate electrode 67. The center of upper end cap electrode 30 is perforated to allow the electron beam generated by filament 60 and control gate electrode 67 to enter the interior of the trap. In the preferred embodiment of the present invention, the hardware for creating and gating the electron beam is controlled by controller 70. When gated "on" the electron beam enters the trap where it collides with sample and, if applicable, reagent molecules within the trap, thereby ionizing them. Electron impact ionization of sample and reagent gases is also a well-known process that need not be described in greater detail. Of course, the method of the present invention is not limited to the use of electron beam ionization within the trap volume. Numerous other ionization methods are also well known in the art. For purposes of the present invention, the ionization technique used to introduce sample ions into the trap is generally unimportant.

Although not shown, more than one source of reagent gas may be connected to the ion trap to allow experiments using different reagent ions, or to use one reagent gas as a source of precursor ions to chemically ionize another reagent gas. In addition, a background gas is typically introduced into the ion trap to dampen oscillations of trapped ions. Such a gas may also be used for CID, and preferably comprises a species, such as helium, with a high ionization potential, i.e., above the energy of the electron beam or other ionizing source. When using an ion trap with a GC, helium is preferably also used as the GC carrier gas.

A trapping field is created by the application of an AC voltage having a desired frequency and amplitude to stably trap ions within a desired range of masses. RF generator 80 is used to create this field, and is applied to ring electrode 20. The operation of RF generator 80 is, preferably, under the control of controller 70. A DC voltage source (not shown) may also be used to apply a DC component to the trapping field as is well known in the art. However, in the preferred embodiment, no DC component is used in the trapping field.

Controller 70 may comprise a computer system including standard features such as a central processing unit, volatile and non-volatile memory, input/output (I/O) devices, digital-to-analog and analog-to-digital converters (DACs and ADCs), digital signal processors and the like. In addition, system software for implementing the control functions and the instructions from the system operator may be incorporated into non-volatile memory and loaded into the system during operation. These features are all considered to be standard and do not require further discussion as they are not considered to be central to the present invention.

The supplemental dipole voltage used in the ion trap may be created by a supplemental waveform generator 100, coupled to the end cap electrodes 30, 35 by transformer 110. Supplemental waveform generator 100 is of the type which is not only capable of generating a single supplemental frequency component for axial modulation of a single species, but is also capable of generating a voltage waveform comprising of a wide range of discrete frequency components. Any suitable arbitrary waveform generator, subject to the control of controller 70, may be used to create the supplemental waveforms used in the present invention. According to the present invention, a multifrequency supplemental waveform created by generator 100 is applied to the end cap electrodes of the ion trap, while the trapping field is modulated, so as to simultaneously resonantly eject multiple ion masses from the trap, as in an ion isolation procedure. Supplemental waveform generator 100 may also be used to create a low-voltage resonance signal to fragment parent ions in the trap by CID, as is well known in the art.

Detector 90 is placed along the the central axis of the trap to measure the ion current leaving the ion trap in an experiment. Perforations in end cap electrode 35 allow the ions to leave the trap in the axial direction. The design, use and control of ion trap detectors is well known and need not be described in detail. In the prior art, the preferred method of detecting ions trapped in the ion trap, particularly ions of a species that had previously been isolated in the ion trap, was to resonantly eject the ions. The use of resonance ejection for the detection of isolated ions has certain drawbacks, as previously described, and, therefore, is not used in the method of the present invention.

Figure 5:
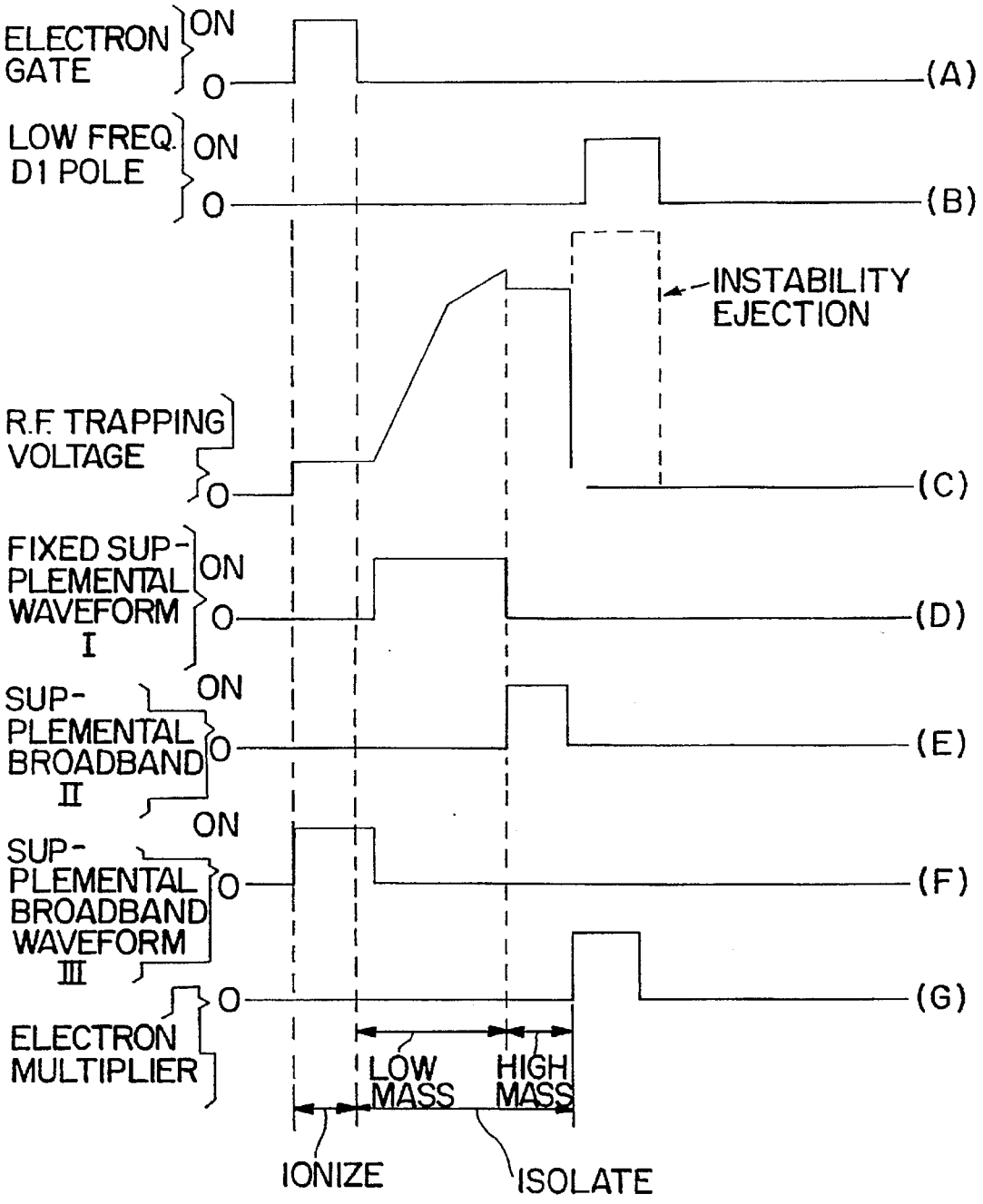
FIG. 5 is a timing diagram showing the sequence of events in accordance with the present invention.

FIG. 5 shows a timing diagram for the sequence of the various voltages applied in accordance with a preferred method of implementing the present invention. As shown in FIG. 5A, initially, the electron gate is turned on and an electron beam is directed into the ion trap, as described, to cause ionization of sample within the trap. As shown in FIG. 5F a multifrequency waveform, as described, is applied to end caps 30, 35 during the ionization step by means of supplemental waveform generator 100, thereby allowing for accumulation of the target ion species within the ion trap. Next, a single ion species is isolated in the trap, as described, using a combination of scanning the trapping voltage while applying a supplemental voltage to rid the trap of low mass ions, and, thereafter applying a second supplemental broadband waveform, while slightly lowering the trap voltage, to rid the trap of any ions higher in mass than the selected ion species. These actions are depicted in FIGS. 5 C–F. Although the foregoing technique of isolating a single ion species within the ion trap is preferred, in accordance with the broad aspect of the present invention, any technique for isolating an ion species may be used, several of which are described above in connection with the background of the invention.

As recognized by the inventor hereof, if a single ion species has been isolated in the ion trap it is not necessary to scan the trap for ion detection. Instead, in accordance with the present invention, all of the ions are rapidly ejected by quickly changing the rf trapping voltage such that the ions are no longer stably held within the ion trap In this context, "quickly" means effecting the desired change in a time interval which of the order of 10 tapping frequency periods or less.

Figure 1:
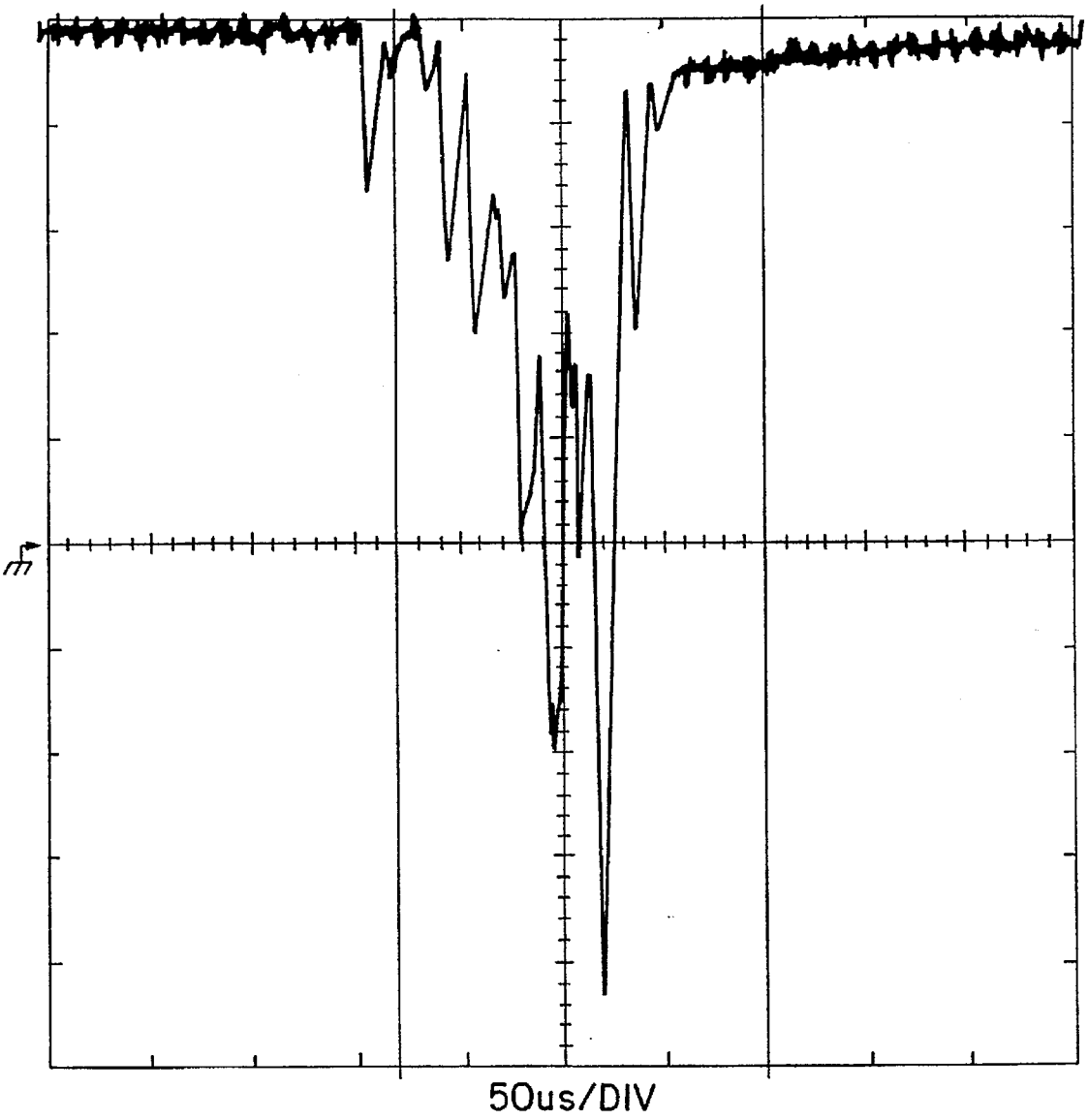
FIG. 1 is a graph showing the detector current of ion of PFTBA, which had been previously isolated in an ion trap and scanned using the resonance ejection scanning method of the prior art.
Figure 2:
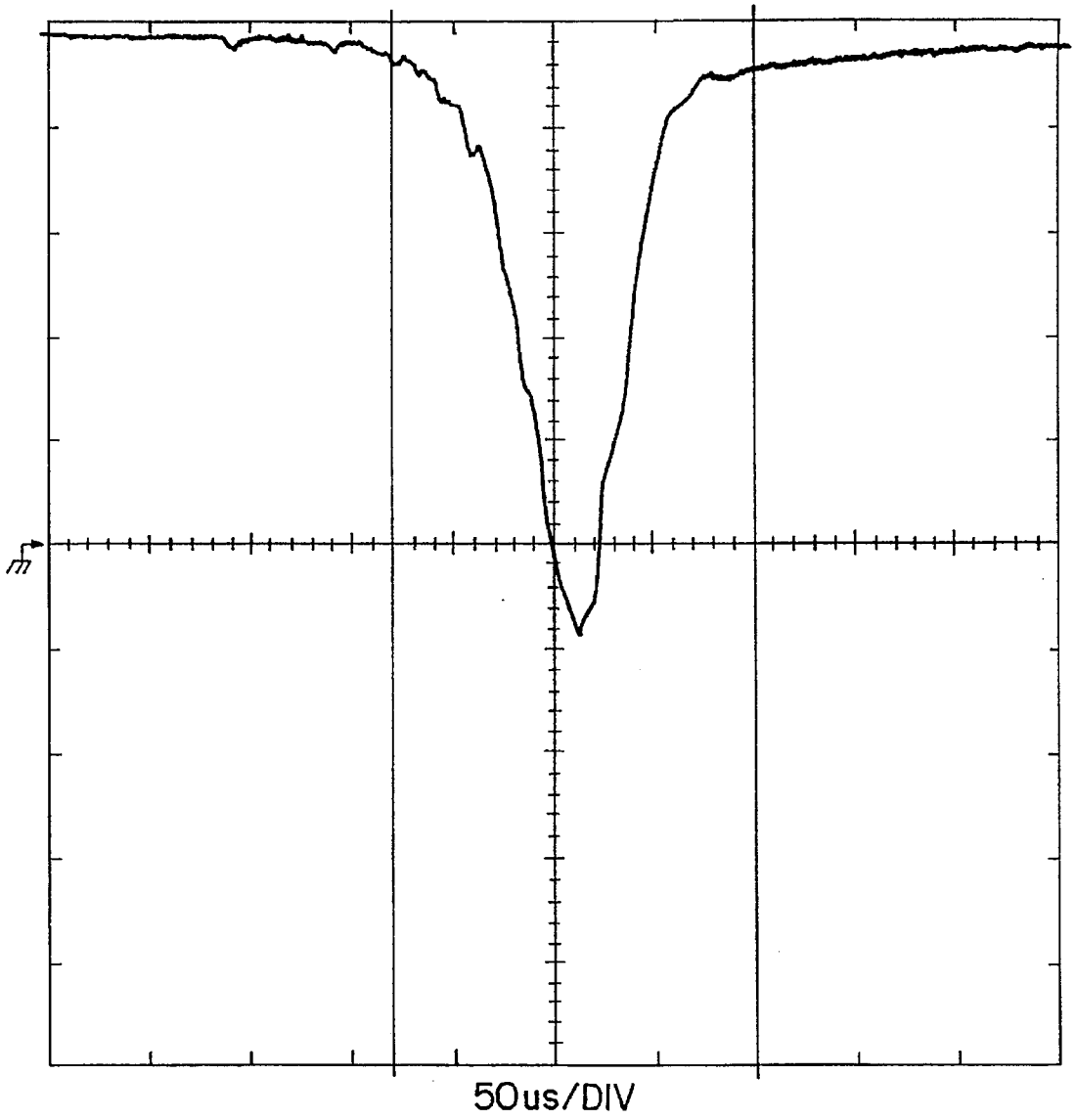
FIG. 2 is a graph showing the average detector current produced after multiple repetitions of the scan of FIG. 1.
Figure 3:
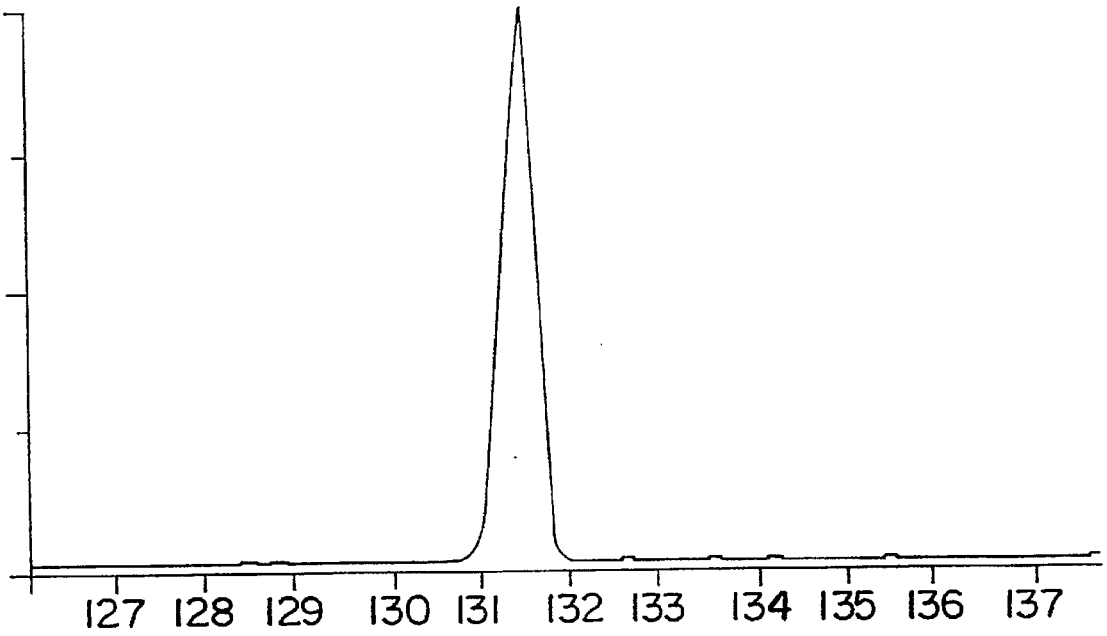
FIG. 3 is a graph showing the results depicted in FIG. 2 after further computer processing to smooth and center the peak.
Figure 6:
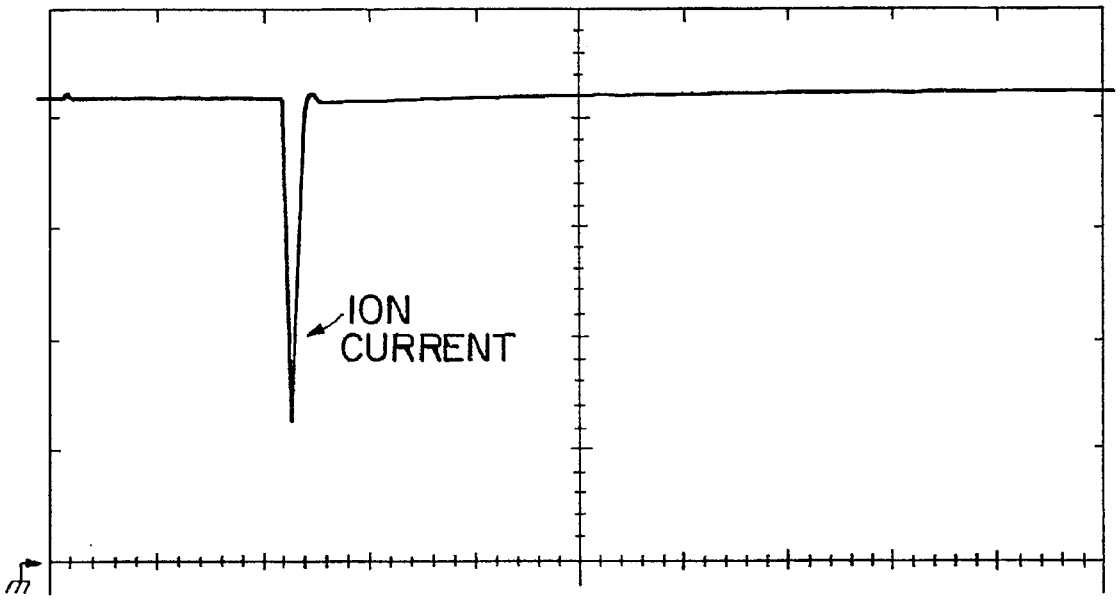
FIG. 6 is a graph showing the signal obtained when an ion species which has been isolated in an ion trap is quickly ejected by quickly increasing the trapping field in accordance with the present invention.

FIG. 6 shows the signal obtained by ejecting the stored ion species PFTBA by quickly raising the rf trapping voltage thereby moving the operating point of the ion outside of the stability envelop, thereby ejecting the ion in the axial direction by instability ejection. Rapid instability ejection is an inherently faster process than the prior art resonance ejection, thereby resulting in a larger peak ion current. In addition, rapid instability ejection does not have the adverse effects stemming from the presence of beat frequencies between the trapping voltage and the resonance scanning voltage, thereby eliminating the peak anomalies present, for example, in the prior art scan of FIG. 1. The rapid increase in the trapping voltage used to obtain the results of FIG. 6 is depicted in FIG. 5C by the dashed line applied following the application of the second supplemental trapping voltage of FIG. 5E.

Figure 7:
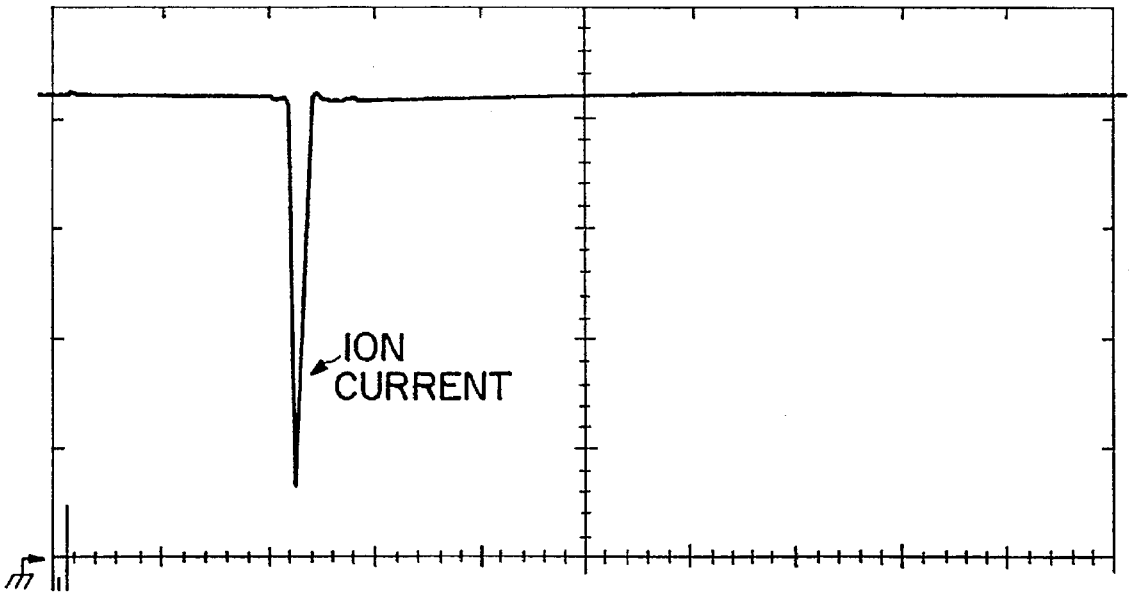
FIG. 7 is graph showing the signal obtained when the method used in FIG. 6 is combined with the synchronized application of a dipole pulse to the end cap electrodes of the ion trap.

Both scanned resonant ejection and instability ejection cause equal numbers of ions to be ejected in both directions along the axis of symmetry. Thus, roughly half the ions in the trap are not detected when either method is used. In accordance with a further aspect of the present invention, a large dipole field is applied to the trap along the axis of symmetry at the same time the trapping voltage is changed to preferentially eject the ions in the direction of the detector, thereby dramatically increasing the percentage of ions in the trap that are detected. FIG. 7 shows a signal obtained when instability ejection is synchronized with application of a large dipole field along the z-axis to preferentially eject the trapped ions in one direction. While a noticeable increase in ion current is seen, the increase is not a doubling as might have been expected. It is believed that when the trapping voltage is quickly raised, the ions gain substantial kinetic energy as they cross the stability boundary. The kinetic energy is sufficient to overcome the dipole field, such that many of the ions still leave the trap in the axial direction away from the detector. It is believed that it would require a very large dipole field to overcome the kinetic energy gained by the ions as they become unstable. Moreover, the required dipole field would be a function of the ion mass, with higher mass ions requiring a larger field.

Figure 8:
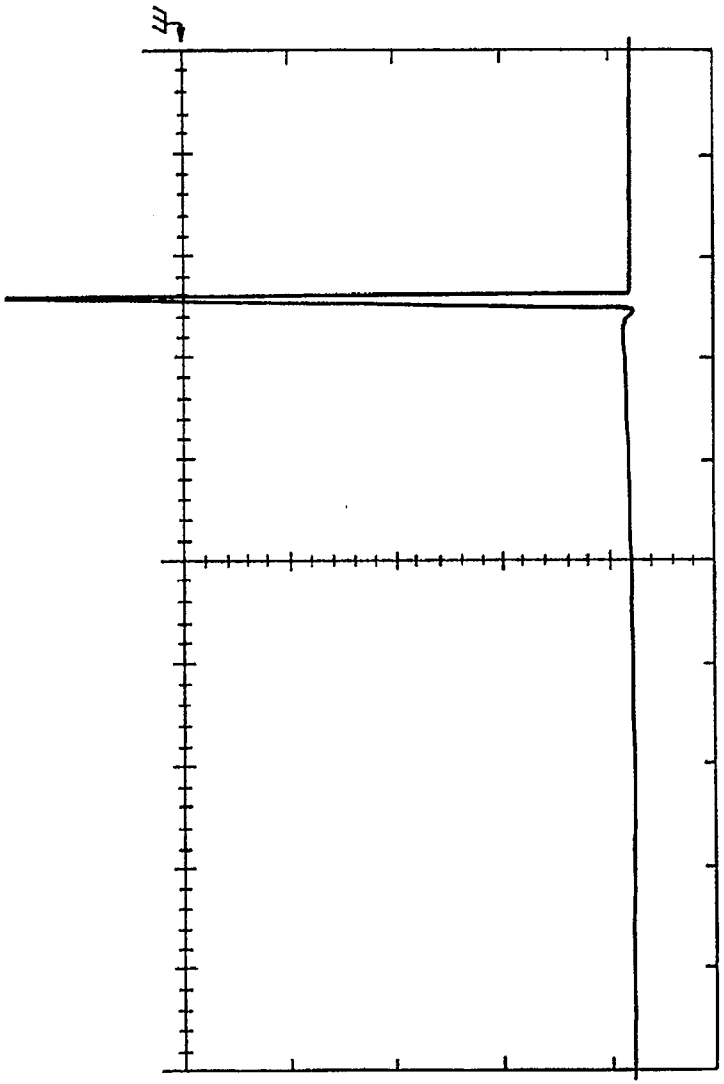
FIG. 8 is a graph showing the signal obtained when the method of FIG. 7 is modified such that the trapping field is quickly reduced to zero rather than increased.

FIG. 8 is similar to FIG. 7 except that the trapping field is reduced to zero, rather than increased, to eject the ions. This is depicted by the solid line of FIG. 5C following the application of the supplemental broadband waveform of FIG. 5E. Normally, eliminating the trapping field will allow ions to escape in any direction. However, it can be seen that as the trapping voltage is reduced to a critical value, the dipole field can easily eject all of the ions in the trap in the desired direction, and a near doubling of the ion signal is obtained.

The combination of the reduced trapping field of FIG. 8 and the intense axial dipole field result in the ions being ejected from the ion trap in a time period that is nine times shorter (~20 μsec) and in a signal that includes nearly the entire ion population of the ion trap. This nearly doubles the ion current over the prior art. The combination of these two steps provides an overall improvement of a factor of eighteen relative to the normal method of scanned resonance ejection. It is not necessary to determine the mass center of the peak as in a scanning method, since only ions of one mass are present in the in the ion trap, and frequency beating is not a problem. The resulting ion current can be integrated and digitally converted by means of an A/D converter that is synchronized with the ejection pulse, in order to obtain a measured signal for the entire charge in the trap. Of course, if desired, the present invention could utilize a sample and hold circuit to measure the peak current rather than the integrated current.

It can be seen that the method of the present invention allows faster determination of the contents of an ion trap thereby increasing the number of cycles that can be performed per second and eliminating the need for microaveraging.

While the present invention has been described in connection with the preferred embodiments thereof, those skilled in the art will recognize other variations and equivalents to the subject matter described. Therefore, it is intended that the scope of the invention be limited only by the appended claims.

What is claimed is:

1. A method of using a quadrupole ion trap mass spectrometer, having end cap electrodes, comprising the steps of:

isolating a selected ion species within the ion trap, rapidly changing the trapping field parameters while substantially at the same time applying a dipole pulse across said end cap electrodes such that the isolated ion species is no longer stably trapped within the trapping field, detecting the unstable ions using an external detector.

2. The method of claim 1 wherein said step of rapidly changing the trapping field comprises substantially eliminating the trapping field voltage.

3. The method of claim 1 wherein the step of detecting comprises integrating the ion current detected by said external detector.

4. The method of claim 1 wherein said isolated ion species is a daughter ion in an $MS^n$ experiment.

5. The method of claim 1 wherein said trapping voltage is changed and said dipole voltage is applied within a time interval of approximately 20 microseconds or less.

6. A method of selectively storing and detecting ions in an ion trap mass spectrometer, comprising the steps of:

applying a trapping field comprising an AC trapping voltage to the ion trap, applying a supplemental dipole voltage to the trap;

scanning the trapping voltage to eliminate ions having a mass lower than a desired ion mass from the ion trap;

applying a broadband waveform to the ion trap to eliminate ions having a mass higher than said desired mass from the ion trap, such that only said desired ion mass remains in said trap;

rapidly changing the trapping voltage; and simultaneously applying a dipole voltage to the ion trap.

7. The method of claim 6 wherein said step of rapidly changing the trapping voltage comprises reducing the trapping voltage to zero.

8. A method of detecting ions in an ion trap mass spectrometer, comprising the steps of:

selectively storing ions of a single mass in said ion trap;

rapidly reducing the trapping voltage;

simultaneously applying a dipole voltage to the ion trap; and detecting the ions that leave the ion trap.

* * * * *